United States Patent [19]

Anderson, Jr. et al.

[11] Patent Number: 5,014,475

[45] Date of Patent: May 14, 1991

[54] STEP MODULE FOR USE IN CONSTRUCTING STAIRWAYS

[75] Inventors: Robert K. Anderson, Jr., Evergreen; Ernest E. Tibbett, II, Arvada, both of Colo.

[73] Assignee: Anderson Industries, Inc., Commerce City, Colo.

[21] Appl. No.: 454,750

[22] Filed: Dec. 21, 1989

[51] Int. Cl.[5] ..... E04F 11/00

[52] U.S. Cl. ..... 52/19; 52/182; 52/183; 52/186; 52/188; 52/189

[58] Field of Search ..... 52/189–191, 52/182–188

[56] References Cited

U.S. PATENT DOCUMENTS

| | | | |
|---|---|---|---|
| 269,863 | 1/1883 | Jackson | 52/182 |
| 302,339 | 7/1884 | Jackson | 52/182 |
| 559,081 | 4/1896 | Kandeler | 52/182 |
| 724,790 | 4/1903 | Bois | 52/191 |
| 894,801 | 7/1908 | Schachner | 52/182 |
| 1,092,572 | 4/1914 | Hartmann | 52/182 |
| 1,304,533 | 5/1919 | Bois . | |
| 1,343,739 | 6/1920 | Nesdall . | |
| 1,541,571 | 6/1925 | Hughes | 52/690 |
| 2,105,565 | 1/1938 | Von Schantz | 52/191 |
| 2,192,151 | 2/1940 | Reynolds | 52/190 |
| 2,193,146 | 3/1940 | Skeel et al. | 52/191 |
| 2,206,862 | 7/1940 | Boyd . | |
| 3,370,387 | 2/1968 | Sivley . | |
| 3,381,775 | 5/1968 | Livers . | |
| 3,608,256 | 9/1971 | Jefferys . | |
| 3,789,556 | 2/1974 | Skinner | 52/191 |
| 4,438,608 | 3/1984 | Hamm | 52/189 |

FOREIGN PATENT DOCUMENTS

| | | | |
|---|---|---|---|
| 93314 | 4/1962 | Denmark | 52/190 |
| 2137626 | 2/1973 | Fed. Rep. of Germany | 52/189 |
| 2921457 | 11/1980 | Fed. Rep. of Germany | 52/188 |

*Primary Examiner*—David A. Scherbel
*Assistant Examiner*—Deborah McGann Ripley
*Attorney, Agent, or Firm*—Timothy J. Martin; Dana S. Rewoldt

[57] ABSTRACT

A step module is provided for use in constructing stairways. Each step module includes a tread portion and a riser portion connected at a nosing so that a plurality of modules may be secured adjacently in stepwise fashion to create a stairway. A shoulder member attaches to the riser portion of one module along the front riser surface parallel to the nosing and thus forms a tread seat for attachment of the distal tread edge of a lower module. When connected, a channel is formed which may be enclosed and filled with a filler material such as an acoustical damping material. The cover may be a wing projecting forwardly of the riser portion and underlying the tread portion of the lower module.

29 Claims, 4 Drawing Sheets

STEP MODULE FOR USE IN CONSTRUCTING STAIRWAYS

FIELD OF THE INVENTION

The present invention relates generally to stairways and specifically to a step module which is useful in constructing stairways and which permits adjustment of the height of the riser during fabrication. This invention is especially directed to a step module utilizing an acoustical dampening material whereby noise such as that produced by stairway traffic is significantly reduced. The invention also includes a method of stairway construction.

BACKGROUND OF THE INVENTION

The advent of multi-floored structures created a demand for stairway structures, and stairway systems are typically found in commercial, office, home and industrial environments. Due to the variety of sizes of stairway systems needed in today's environment, certain difficulties have been encountered in the design and fabrication of stairway systems; for example, riser sections in such stairways have to be exactly the correct height to fit each particular floor to floor height of the installation and still comply with regulatory laws. To simplify the process of constructing stairs individual step units or step modules capable of being joined together to form a pre-fabricated stairways have been developed. Examples of stair step modules which can be used to make a pre-fabricated stairway are described in the following list of patents:

| U.S. Pat. No. | Inventor | Date of Issue |
|---|---|---|
| 1,304,33 | Bois | May 27, 1919 |
| 1,343,739 | J. T. Nesdall | June 15, 1920 |
| 2,206,862 | Boyd | July 9, 1940 |
| 3,381,775 | Livers | May 7, 1968 |

While the above-referenced patents are suitable to make a pre-fabricated stairway, each of the individual step modules described in these patents have to be designed specifically for the installation in question, that is, the riser height of these various step modules is not adjustable. In commercial buildings and other structures, however, the floor to floor height varies anywhere between eight feet to fifteen feet with the variation in intervals as small as ¼ inch. Historically, stairways had to be designed with the correct riser heights and individually produced to fit the floor to floor height specification of each installation. This method of producing stairways was time consuming and costly. It may be appreciated that it is therefore desirable to fabricate a stair step module which is a standardized component that can be fastened together with similar modules in such manner that the vertical height of the riser of each step module can be varied to suit the particular installation.

There has, in the past, been some development of step modules having adjustable riser heights for stair step assemblies. One such stair step module which is adjustable in riser height is shown in U.S. Pat. No. 3,608,256 issued Dec. 1, 1967 to Jefferys. In the Jeffery's patent a step module is shown wherein a step module is comprised of three separate parts. Each stair step module includes an inverted L-shaped portion having a downwardly depending leg with a plurality of spaced apart grooves extending rearwardly therefrom; and a reverse L-shaped riser having a horizontal leg and a vertical upwardly projecting leg having a plurality of spaced apart grooves extending forwardly therefrom; and a tread portion. The tread portion is adapted to interlock with the horizontal leg of the reverse L-shaped riser. The spaced apart grooves of the reverse L-shaped riser and the spaced apart grooves of the inverted L-shaped portion are adapted to be mated. When mated with one another the reverse and inverted L-shaped portions form a riser which can be adjusted to varying heights. Spaced apart grooves of the lower reversed L-shaped vertical leg are visible when the stair step assembly is formed into a staircase unless the riser height is the minimum riser height to which the stairway can be adjusted.

Another example of a stair step module is shown in U.S. Pat. No. 3,370,387 issued Feb. 28, 1968 to Sivley. Here, an adjustable riser height is shown wherein a two piece system is utilized to vary the riser height. One piece of the stair step module is a tread member with a rear edge riser portion that generally extends upwardly and terminates in an inverted "J" hook design. Another piece is formed as a riser member that depends from a second tread member in a vertically downward direction and that has a "J" hook flange. The inverted "J" hook riser portion extending from the lower tread and the flange on an adjacent riser mate with one another thus allowing simple installation and connection of the various stair step modules. The riser height with this inverted "J" hook mating system can be adjusted by welding the upper portion of the inverted "J" hook to the back portion of the riser. When the riser height is less than the maximum riser height allowed by the "J" hook mating system the inverted "J" hook does not rest securely inside the riser's "J" hook flange; therefore, the pressure and weight placed on the tread of the stair step assembly is held only by the weld on the back portion of the riser. The adjustment of the riser is further supported by the attachment of the stair step assembly to the lateral support or stringers; however, the force of the pressure on each individual step module is squarely felt on the weld between the mated portions of the two risers.

Despite the innovations shown in the various patents described above, there still remains a need for an improved standardized stair step module capable of being utilized in any on installations having different floor to floor height. There is also a need for a step module adapted to form an acoustically dampened, pre-fabricated stairway which is simple in construction, economical to manufacture and capable of withstanding industrial weight stair step traffic. Further, there is a need for a stairstep module in which the adjustable portion of the riser is completely out of view after installation, thus improving the appearance of the completed stairway and providing a strong and secure attachment of the stair step units.

SUMMARY OF THE INVENTION

It is an object of this invention to provide an adjustable stair step module in which a standardized module can be attached to other standardized modules to permit the vertical space between adjacent treads to be adjusted to the specifications of that installation.

It is a further object of this invention to provide a stair step assembly in which the attachment of the modules is not evident after installation.

Another object of this invention is to provide a step modules which are of a simple construction, which are economical to manufacture and which are easy to assemble into a stairway.

It is also a further object of this invention to provide a step module which is adequately braced when joined into a stairway assembly to allow the stress of heavy stairway traffic to be easily sustained.

It is also a further object of this invention to provide a stairway assembly which reduces stairway traffic noise.

Yet another object of the present invention is to provide a method of stairway construction employing acoustical dampening features.

In the broad form of the present invention, then, a stair step module is used in constructing stairways wherein a plurality of stair step modules are attached one to another as adjacent pairs of step modules. A first one of an adjacent pair of modules defines an upper step module, and a second one of the adjacent pair defines a lower step module. When connected together, the upper and lower modules of an adjacent pair respectively provide upper and lower treads for the stairway. Each stair step module accordingly includes a tread portion and a riser portion connected together to form a nosing. The tread portion has an upper surface and a lower surface and a distal tread edge opposite the nosing; the riser portion has a front surface and a rear surface and a distal riser edge opposite of the nosing. A first shoulder structure attaches to the front surface of the riser portion of an upper step module to form a shoulder support so that a lower module may be connected to an upper module. To this end, the shoulder support is substantially parallel to the nosing and is adjustably attached at a specific distance below the nosing in accordance with the desired riser height. The first shoulder structure thus forms a tread seat adaptable for securing the distal tread edge of the lower step module in a supported position. Each first shoulder structure is spaced a distance above the distal riser edge of an upper step module so that the riser portion and the tread portion of a lower step module, and the riser portion of an upper step module form an inverted channel when attached to one another. A cover structure for enclosing the channel opposite the tread portion is also included. The cover structure can include a cover plate which is mountable between the rear surface of the riser portion of a lower step module and the distal riser edge of the upper step module.

In a second embodiment each step module is Z-shaped and accordingly includes a wing portion that is connected to the riser portion along the distal edge. This wing portion projects oppositely of the tread portion. The wing portion of an upper step module underlies the tread portion of the lower step module in a spaced relation and defines the cover structure when the upper and lower step modules are attached together. As in the first embodiment, a first shoulder structure is attached to the front surface of the riser portion of an upper step module to form a shoulder support so that a lower step module may be connected to an upper module. To complete the attachment of a pair of step modules to form a stair step, a second shoulder structure may be attached to the rear surface of the riser portion of the lower step module. This shoulder structure is oriented substantially parallel to the nosing, and the second shoulder structure is adapted for supporting and attaching the cover between the adjacent riser portions. In an alternative attachment of the step modules, a second shoulder structure is not utilized; instead the cover is secured to the rear surface of the riser portion of the lower step module by methods such as welding, bolting, etc.

In a third embodiment, both the upper and lower modules of an adjacent pair of step modules have a tread portion and a riser portion connected together to form a nosing. The tread portion has an upper surface and a lower surface and a distal tread edge opposite the nosing. The riser portion has a front surface and a rear surface and a distal riser edge opposite of the nosing. A first shoulder structure attaches to the front surface of the riser portion of an upper step module to form a shoulder support so that the lower module may be connected to the upper module forming an inverted channel.

To complete the attachment of the pair of steps modules and to enclose the inverted channel, a channel shaped cover having a plate with an upwardly projecting distal plate edge and an upwardly projecting proximal plate edge, is secured opposite the tread portion. This channel shaped cover encloses the inverted channel and forms an enclosed chamber. One upwardly projecting plate edge is secured slightly above the distal riser edge to the rear surface of the riser portion of the upper step module, the other upwardly projecting plate edge secured to the rear surface of the riser portion of the lower step module.

After the individual step modules of the embodiment are attached in a secure manner, the outside ends of the channels formed in the stair step modules are enclosed to create a hollow chamber. The enclosing structure is a lateral stairway support defined as a wall support, stringers, and the like. This chamber is thus bounded by the riser portion and the tread portion of the lower step module, and the riser portion of the upper step module, the cover structure and the enclosing structure. The enclosed chamber can then be filled with material useful for acoustical sound dampening or structural strengthening material. This may be accomplished by providing a port in the cover structure through which the filler material is injected. A plug then seals the port.

The present invention also contemplates a stairway assembly structure constructed of the step modules and adapted to be positioned between two landing portions. Landing portions can be a floor or a intermediate landing. A stair step assembly is adapted so that it can be installed or mounted between lateral stairway supports such as stringers or wall supports. The present invention includes a lower landing portion and an upper landing portion and a plurality of stair step modules which are attached to one another as adjacent pairs of lower and upper step modules that extend from the lower landing portion to the upper landing portion. The step modules are attached one to another as previously stated.

One of the purposes of the stairway assembly filed with acoustical dampening material is to lessen traffic noise. To fully accomplish this objective, the landings also are designed to accommodate sound dampening material. A landing includes a landing surface having a distal edge and a proximal edge. The distal edge is adapted to fit tightly against the uppermost step module. The proximal edge is adapted to abut the vertical support defined as a terminal wall of a bottom step module or an upper flight of steps. The landing surface is supported at the distal edge and the proximal edge by headers. Intermediate headers may also be provided. For example, a flight header is attached and supports the distal edge, and landings header support the proximal and the mid portions of the landing surface. The landing surface and the headers form an inverted channels. An enclosed chamber is formed by the secure attachment of a cover structure underneath the landing surface. The cover structure is formed by two cover plates that extend between two respective landing headers in a spaced relation to the landing surface. The landing surface, the headers, the lateral supports and each cover structure forms an enclosed chamber. Each enclosed chamber formed in the landing structure is then provided with filler material whether its strengthening material or acoustic material to be utilized to sound deaden and lessen traffic noise.

These and other objects of the present invention will become more readily appreciated and understood from consideration of the following detailed description of the preferred embodiments when taken together with the accompanying drawing, in which:

DETAILED DESCRIPTION OF THE PREFERRED EMBODIMENT

The present invention relates to a stair step assembly and particularly to the step module which is adapted to be connected to another in a manner which allows the riser height of the step modules to be varied. Broadly, the present invention includes various stair step assembly elements such as step modules, lateral supports, landings, and railing structures. Specifically the present invention teaches a step module with an adjustable riser feature and connectable to a landing so that a stairway can be formed between two landing areas Both the step modules and the landings define chambers, which are positioned under the tread portions, and these chambers can be filled with a variety of different filler materials some of which are noise deadening.

Figure 1:
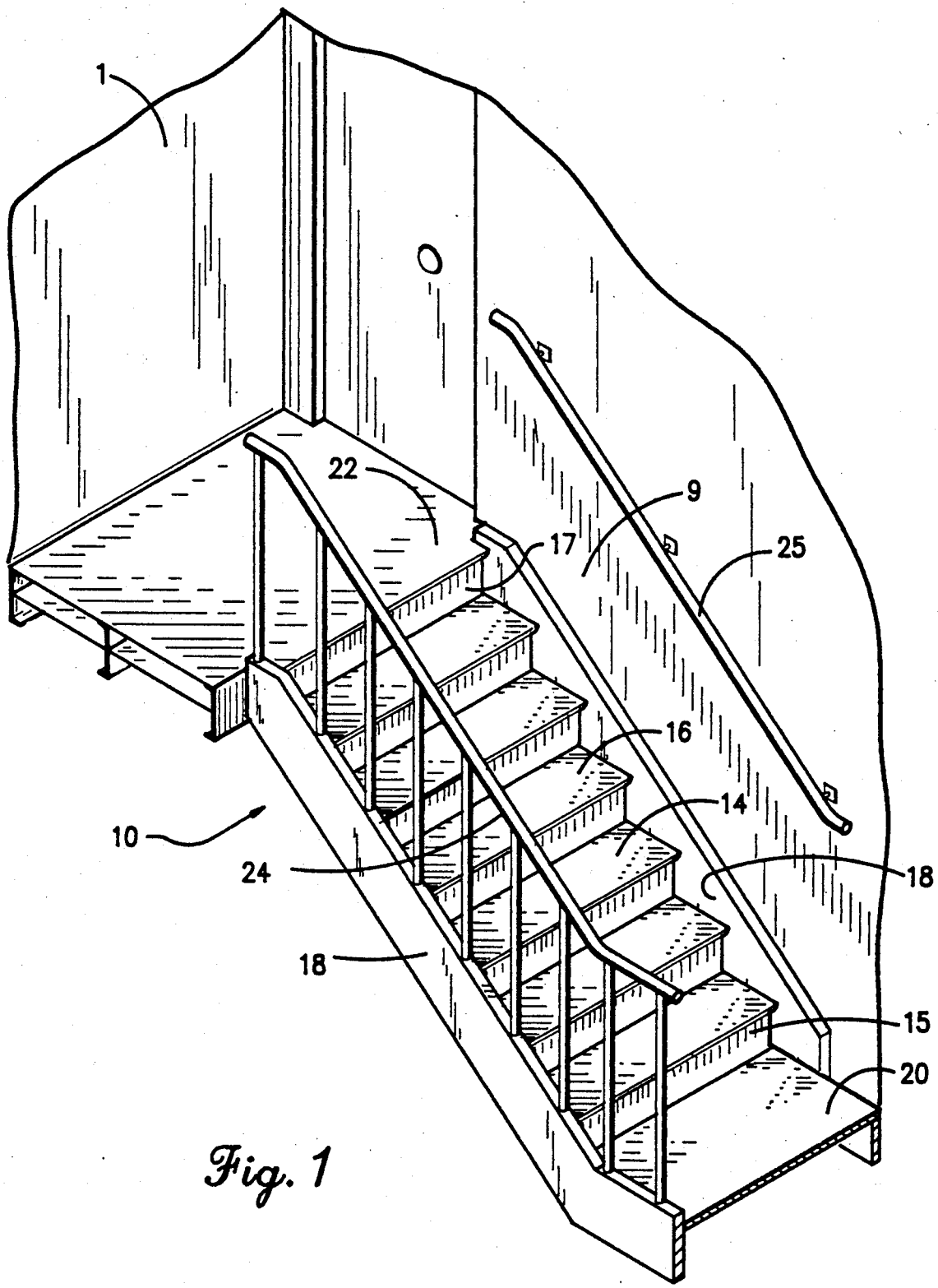
FIG. 1 is a perspective view of a stair step assembly constructed of the stair step modules and landings, according to the present invention along with associated lateral supports and railings therefore.

For the purpose of reference a representative stairway 10 is displayed in FIG. 1 which incorporates the step modules and landings according to this invention. As shown in FIG. 1, a stairway 10 has a plurality of step modules attached to one another. Adjacent pairs of step modules such as representative modules 14 and 16 define an upper step module 16 and a lower step module 14. Also depicted is lateral supports 18 which is a standard stringer but which can also be wall support portions and the like. The stairway thus extends between a lower landing 20 and an upper landing 22. Lowermost step module 15 mounts to landing 20 while uppermost step module 17 mounts to landing 22. The stairway is provided with hand railings 24 and 25.

Figure 2:
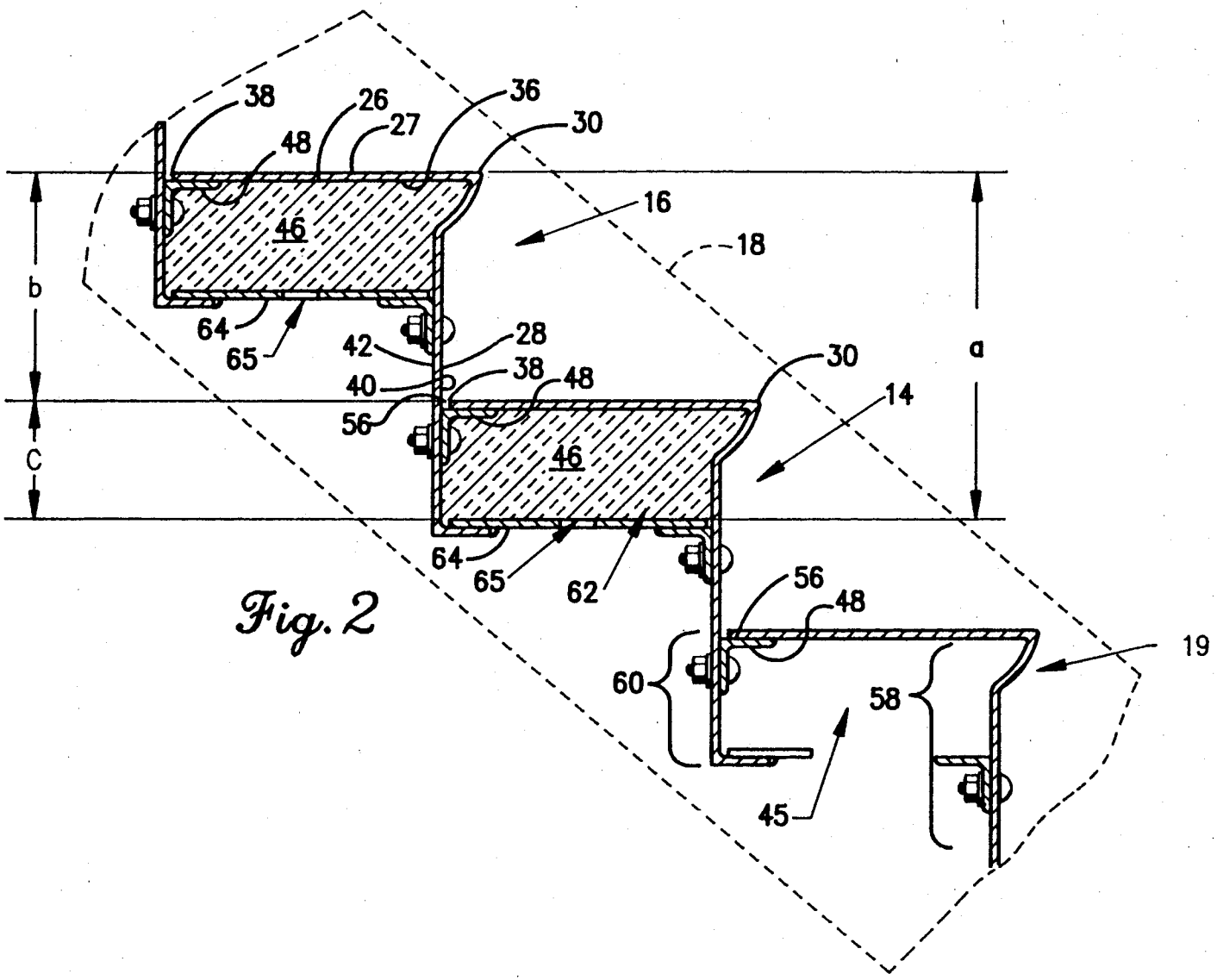
FIG. 2 is a side view in partial cross section showing the first embodiment of the present invention.
Figure 3:
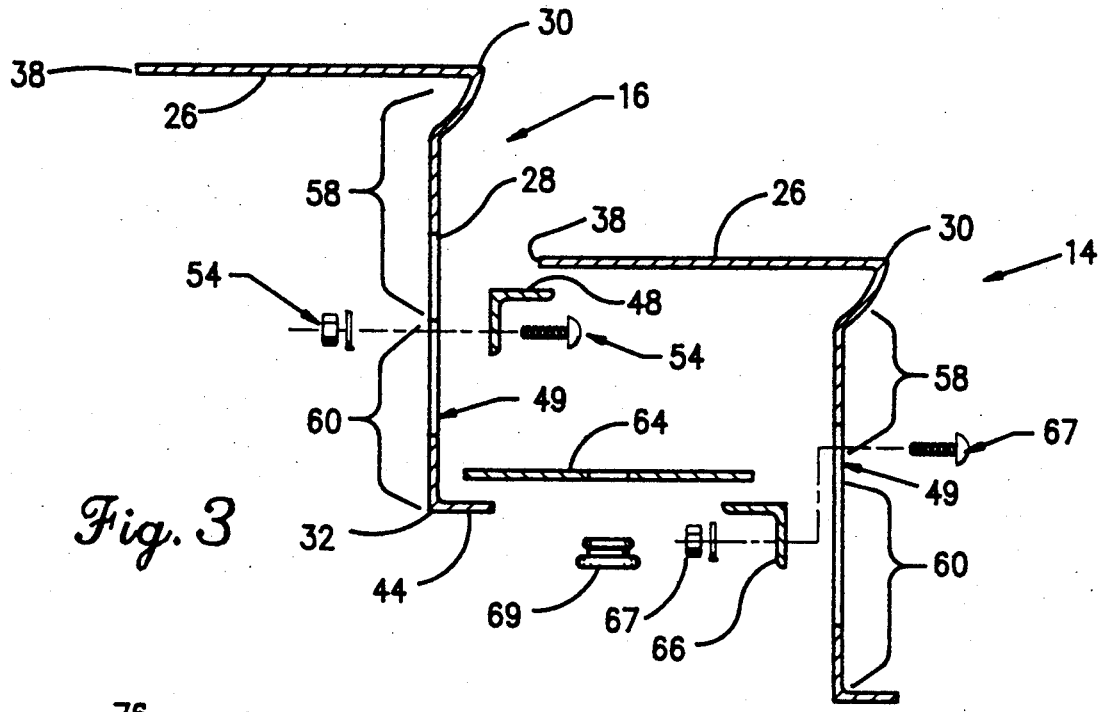
FIG. 3 is an exploded view of the stair step module according to a first embodiment of the present invention.

The step module according to the first preferred embodiment of the present invention is best shown in FIGS. 14, 16 and 3. Turning to FIGS. 2 and 3, the individual components of representative step modules 2 can be seen. It should be understood and appreciated that adjacent ones of the step modules 14, 16 define the upper step modules and a lower step modules. Thus, for sake of explanation, FIG. 2 shows the upper step module 16 connected to a lower step module 14 although step module 16 would define the lower step module for its next upper step module. Likewise, lower step module 14 forms an upper step module for step module 19.

Upper step module 16 has a tread portion 26 and a riser portion 28 which are connected together along a nosing 30 as required by most commercial building codes. Nosing 30 is constructed to have a slight upward and outward projection opposite the distal edge 32 of the riser portion 28. The tread portion 26 has an upper surface 27 that can be made into a non-slip surface by any number of techniques including but not limited to, surface grooves, surface pimples, a rough non-slip adhesive coating and the like, all as is known in the art. The tread portion 26 also has a lower surface 36 and a distal edge 38 of the tread portion 26 which is located opposite of the nosing 30. The riser portion 28 has a vertical height "a" (shown in FIG. 2), a front surface 40 that is visible upon completion of the stair step assembly and a rear surface 42 which is not visible upon completion. The distal edge 32 of the riser portion 28 has a lip 44 which is connected thereto. Lip 44 projects oppositely of the tread portion 26 of the same step module. Stringer 18 is shown in phantom.

The components utilized in securely attaching consecutive lower step modules 14 to upper step modules 16 to form a stair step assembly as well as one method of attachment are clearly depicted in FIGS. 2 and 3. As is shown in FIG. 3, step modules 14 and 16 are attached by a method that accomplishes two primary goals: adjustability of the riser height; and formation of a channel capable of containing a number of filler materials 46. To securely attach the step modules 14 and 16 together a first shoulder structure, which can be an angle iron 48, is positioned substantially parallel to the nosing 30. As is shown in FIG. 2, the first shoulder 48 is located a first distance "b" below the nosing 30. The first distance "b" is approximately the same as the end user's desired riser height same as the riser height desired by the user. The riser height "a" minus the distance "b" yields the height "c" of an inverted channel, such as representative channel 45 that is formed when two adjacent step modules are mounted to one another. Under most building codes the riser portion 28 of a stairway is between six and eight inches in height. Therefore the riser portion 28 of the step module 12 is usually formed to be eight and one-half inches to ten inches, although it should be appreciated that the riser portion 28 can be any variety of heights to meet various needs of the end user.

The first shoulder 48 forms a tread seat 56 that supports the distal tread edge 38 of the lower step module 14 in an easily securable position. The distal tread edge 38 is securely attached to the riser portion of the upper step module 16 by methods such as bolting, welding, etc. To this end, if desired, adjustment slots 49 may be provided. It should be appreciated that, by attaching the first shoulder 48 at variable first distances below the nosing 30, the stair step assembly may be variably adjusted to have different effective riser heights depicted herein as the first distance "b". Since the sum of the first distance "b" and the second distance "c" must always equal the riser height "a" increasing the first distance "b" will decrease the second distance "c". Thus, as the first shoulder 48 is lowered and raised with respect to the nosing 30 and secured into a position on the upper step modules 16 the riser height and the depth of the channel 45 vary proportionately.

When attaching step modules 12 to one another to form a stair step assembly, the first shoulder 48 is spaced in a selected second distance 54 above the distal riser edge 32 and fastened into place. This can be accomplished by nut and bolt sets 54, shown in FIG. 3, which are received in slots 49. The shoulders 48 are preferably welded into position, and it should thus be understood that slots 49 are nut and bolt sets 54 can be eliminated. However, if nut and bolt sets 54 are used, they can be removed after welding. The distal tread edge 38 of the tread portion 26 of the lower step module 14 is then positioned to rest on the tread seat 56 which is formed by the first shoulder 48 when it is connected to the riser portion 28 of step module 16.

The lower riser portion 60 of the upper step module 16, the upper riser portion 58 of the lower step module 14 and the tread portion 26 of the lower step module 14 form the walls or boundaries of an inverted channel 45. To enclose the inverted channel 45 a cover plate 64 can be used. Cover plate 64 can be a flat plate or a slightly angled plate or a plate with a lip that runs around the edge. The actual shape of the cover plate 64 in the first embodiment is not critical as long as it is capable of being adequately secured to the upper riser portion 58 and a lower riser portion 60 of each of the two stair step modules. This cover plate 64 provides a cover means that fulfills at least two purposes. First it strengthens and secures the stability of the attachment of the step modules 16 and 14 to each other by acting as a reinforcing brace. Second it forms an enclosed chamber 62 which can be filled with a filler material 46 as is shown in FIG. 2. Lip 44 projects oppositely of the tread portion of the same step module, and, when the lower step module 14 is attached to the upper step module 16, the respective lip 44 underlies the tread portion of the lower step module 14 in a spaced relation and acts as a seat for the cover plate 64.

The cover plate 64 can thus be mounted between the rear surface 42 of the lower riser portion 60 of the lower step module 14 and the distal riser edge 32 of the upper step module. The cover plate 64 is secured to the rear surface 42 of the riser portion 60 of the lower step module by a metal weld or some other securing means. For example, a second shoulder 66, which may also be an angle iron, can be used to secure the cover plate 64 to the rear surface 42 of the riser portion 60 of the lower step module 14. The second shoulder 66 is attached by nut and bolt sets 67 or, in the alternative, a weld is made to the rear surface 42 of the riser portion 60 of the lower step module 14 in a position that is substantially parallel to the nosing 30. If the second shoulder is employed, then the second shoulder 66 is specifically adapted to support and allow attachment of the cover plate and to form a reinforcing brace in the bottom of the channel between adjacent riser portions. Again, attachment of shoulder 66 can be by nut and bolt sets 67 after which shoulder 66 can be welded in place and the nut and bolt sets removed.

Figure 4:
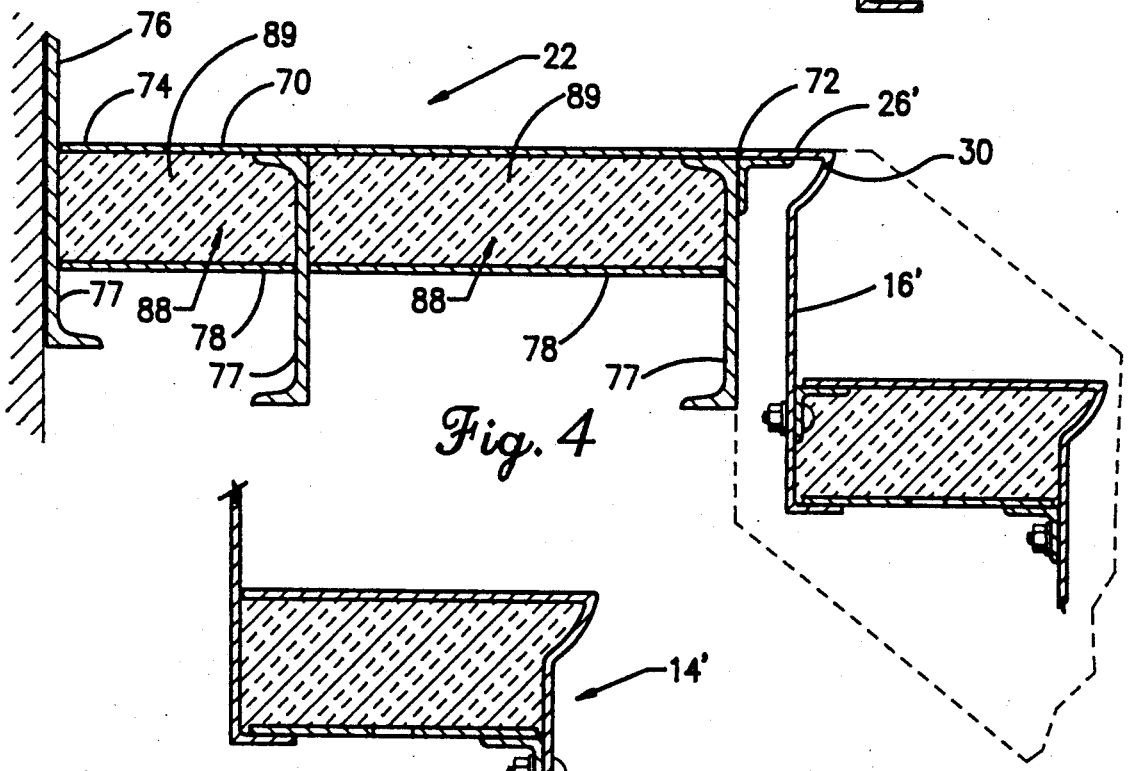
FIG. 4 is a side view and partial cross section showing the interior of a representative landing in accordance with this invention.
Figure 5:
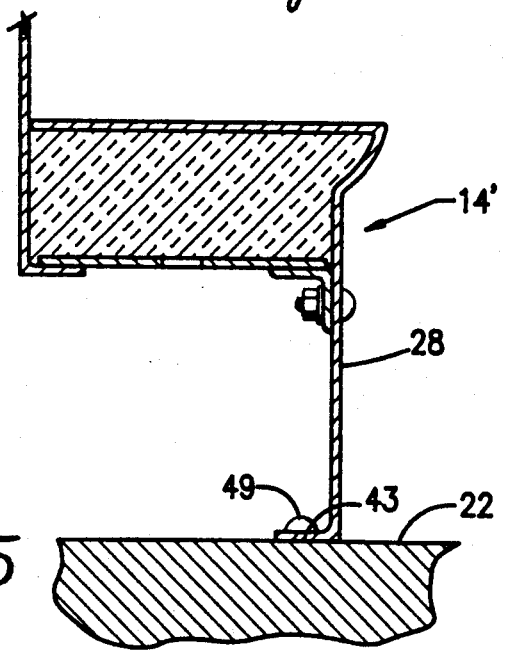
FIG. 5 is a side view in partial cross section showing the lowermost step module of the present invention attached to a lower landing.

The connected step modules are formed into a stairway as shown in FIG. 1 by connecting the bottommost step module to a lower surface and the topmost step module to a top support surface. These support surfaces include but are not limited to landings, such as landings 20 and 22, and/or floors. As is shown in FIG. 4, uppermost step module 16' can also be modified by cutting the length of tread portion parallel to the distal edge. The shorter topmost tread section allows the step module to be more securely attached to the support surface. Here, tread portion 26' is cut proximate nosing 30. A shoulder 31 suppots this shortened tread in an abutting relation to landing 22. Lowermost step module 14', shown in FIG. 5, can be modified as necessary to mount to lower landing 20. On such modification includes rearwardly turned lip 43 formed by cutting lip 44 off of riser 28 and folding the lower portion of riser 28 at the desired riser height. Lip 43 is then secured to lower landing 22, for example, by a bolt 49.

As noted above, the set of step modules are securely positioned in the chosen installation area by lateral supports 18 such as stringer or wall supports 9 and the like. These support structures operate to enclose the opposite ends of each channel 45 to form an enclosed chamber 62 bounded by the riser and the tread portion of a lower step module, the riser portion of an upper step module, the cover plate and the enclosing structure, all as is shown in FIG. 3. This enclosed chamber 62 is adapted to contain a variety of filler materials 46 such as acoustical dampening materials, or strengthen materials. The acoustical dampening materials includes, rubber, foam rubber insulating materials such as polyurethane foam, urethane foam, styrofoam various plastic materials and the like. Preferably, a close-celled plastic foaming material is employed to have two characteristics. First it should be expandable to put outward pressure on the chamber walls, and second, it should be flame spread retardant. The strengthen material includes cement, epoxy, rubberized material and the like.

To fill the enclosed chamber 62 any of the elements bounding the interior of the chamber can be formed with small holes or have small holes drilled into the elements such that the holes are capable of allowing the filler material to be inserted into the chamber. These holes are then securely plugged to maintain the filler materials within the chamber. For example, and as shown in FIGS. 2 and 3, cover plate 64 can have a port 65 centrally located therein. Filler material 46, which may be a foaming polymer, can be injected into chamber 62 through port 65 and port 65 can then be sealed with plastic plug 69. It has been noted that placing the holes in the upper riser portion 28 or in the cover plate 64 allows the holes to be plugged without making the plugs visible when the stairway is installed.

A representative landing 22 is shown in FIG. 4. Here, landing 22 includes a landing surface 70 having a proximal landing edge 72 which is adapted to fit tightly against tread 26' of the uppermost step module 16'. The distal landing portion 74 of the landing surface abuts terminal wall 76 or, as should be understood by the skilled artisan, a bottom step module of an upper flight of stairs. The landing surface 70 of landing 22 is supported by headers 77 more specifically defined as flight headers and landing headers. A cover structure is located underneath and in spaced relation to the landing surface 70. The cover structure is formed by cover plates 78 that extend between and that are affixed to respective headers 77. The landing surface 70, the headers 77, and plates 78 form an enclosed chamber 88 having an interior bound by the landing surface 70, the lateral landing supports, the headers 77 and the cover plate 78. This chamber 88 can be filled with acoustical dampening material or strengthen material 89. The landing 22 can be attached to a vertical support 1 such as a wall or the bottom riser of a second stair step assembly by means of an outer header 77. Furthermore it should be noted that a stair step assembly can be formed with two landing or with one upper landing and no lower landing, vice versa or with no landings in which case the plurality of step modules are connected directly to a bottom support such as a floor and a top support such as an upper floor, all as would be understood by the ordinarily skill person in this field.

Figure 6:
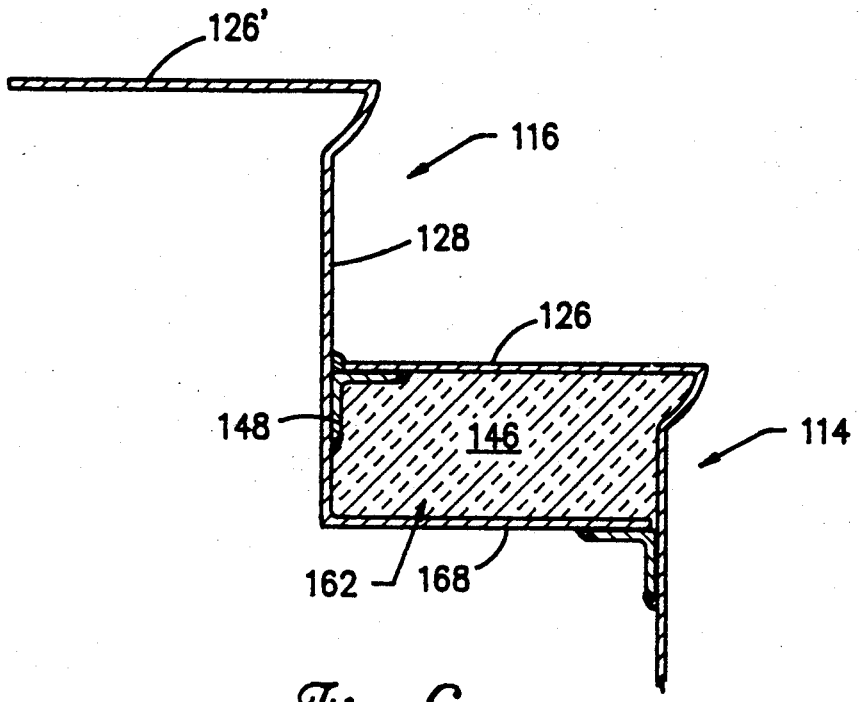
FIG. 6 is a side view in cross section showing a second embodiment of the present invention.

The second embodiment of the present invention is shown in FIG. 6. This figure shows the attachment of a modified upper step module 116 and a modified lower step module 114, and it should be understood that attachment method of this second embodiment is substantially the same as that described above. In FIG. 6, the tread portion 126 of the lower step module 114 is secured by a first shoulder 148 to the riser portion 128 of the upper step module 116. However, in the second embodiment shown in FIG. 6, a wing portion 168 is formed integrally with tread portion 126', and riser portion 128. Thus win portion 168 defines a unitary cover plate to replace the separate cover plate, such as plate 64, described above. Thus, as shown, wing portion 168 extends and projects oppositely of the tread portion 126'of its step module. When two step modules are attached the wing portion 168 underlies the tread portion 126 of the lower step module 114 in a spaced relation. The upper rise portion 160, the tread 190 of the lower step module and the lower riser portion 194 therefore form a chamber 162 that receives filler material 146.

Figure 7:
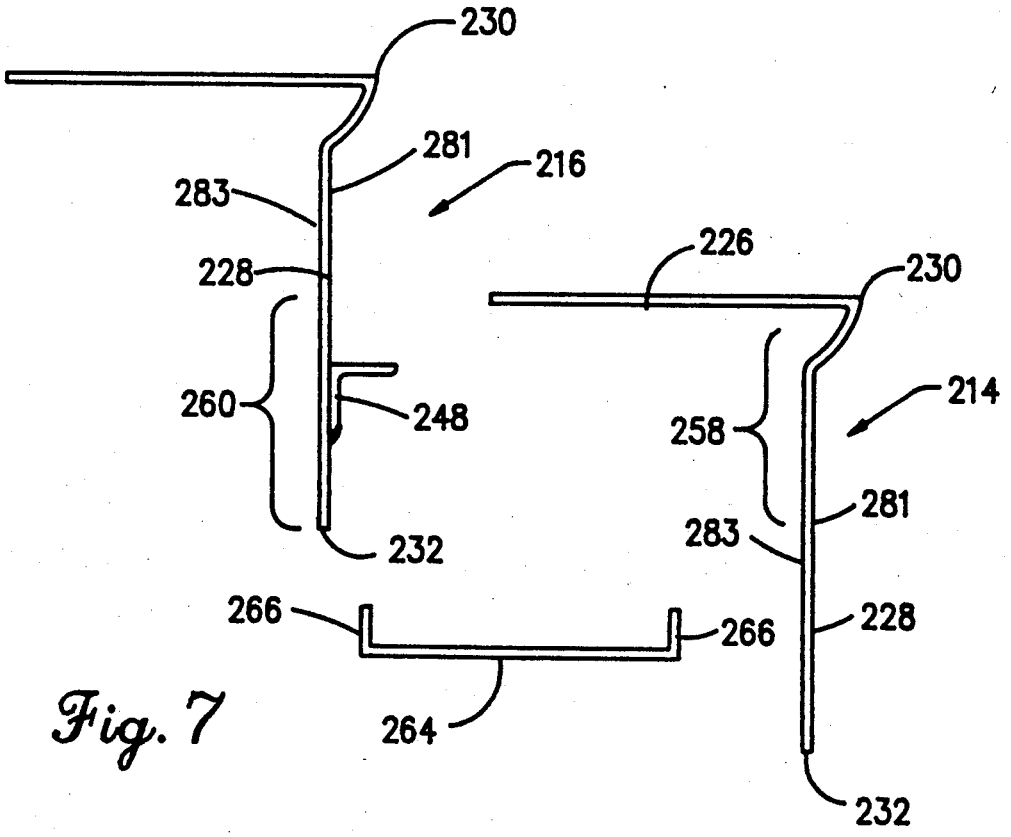
FIG. 7 is a side view in partial cross section showing a third embodiment of the present invention.

The third embodiment of the present invention is shown in FIG. 7. This figure shows the attachment of the lower step module 214 having a tread portion 226 and a riser portion 228. The upper step module 216 also has a simliar tread portion and riser portion. It should be understood that the attachment method of the third embodiment is substantially similar to the method described in the other two embodiments although this method is simplified. The method of attachment depicted in the third embodiment requires the use of only one shoulder structure 248.

In FIG. 7, the tread portion 226 of the lower step module 214 securely rests on and is attached to the shoulder structure 248. The shoulder structure 248 is positioned at the desired height below the nosing 230 and then secured to the riser portion 228 of the upper step module 216. The tread portion 226 and the upper riser portion 258 of lower step module 214 along with the lower riser portion 260 of the upper step module 214 for an inverted channel that may then be enclosed by a channel shaped cover plate 264 having an upwardly projecting edges 266 that are secured in a spaced apart relation beneath the tread portion 226 of the lower step module 214.

The both step modules 216 and 214 have a riser portion 228 having a front surface 281 and a rear surface 283 and a distal riser edge 232 opposite the nosing 230. One upwardly projecting edge 266 of the channel shaped cover plate 264 fits snugly against the rear surface 283 of the riser 228 of the upper module and is securely attached thereto by welding. The other upwardly projecting edge 266 of the channels shaped cover plate 264 fits snugly against the rear surface 283 of the lower riser portion 228 and is securely attached. When the lower step module 214 is completely attached to the upper step module 216 an enclosed chamber is formed similar to that described with respect to the first embodiment of this invention. This chamber can then be filled with filler material Acoustical filler materials that exhibit the following two characteristics are preferred: one, the material should place a slight pressure on the chamber, that is, expanding material such as insulating foams; two, the material should have a low flame spreader index as a safety precaution.

This invention is also directed to the method of forming a stairway between an upper landing and a lower landing. A plurality of step modules each having a riser portion and a tread portion are connected together to from a nosing. The tread portion has an upper surface, a lower surface, and a distal tread edge opposite of and parallel to the nosing. The riser portion has a front surface, a rear surface and a distal riser edge opposite of and parallel to the nosing. The plurality of step modules are attached together in a step-wise manner, such as by welding, with the tread portion of one step module attached to the front surface of an adjacent step module along a line of attachment spaced above the distal riser edge of the adjacent step module and below the nosing in a substantially parallel relation thereto whereby an inverted channel is formed. Next, the uppermost step module is attached to an upper support surface such as a landing so that the riser portion of the uppermost step module depends downwardly from said upper landing. And a lowermost step module is attached to the lower support surface such as a landing so that the riser portion of the lowermost step module extends upwardly from the lower landing. Next the channels are enclosed to form a chamber having a bounded interior. This interior is then filled with a filler material, such as by injection through a port that may then be plugged. The filler material can be any type of material capable of providing end user with his desired attributes.

Accordingly, the present invention has been described with some degree of particularity directed to the preferred embodiment of the present invention. It should be appreciated, though, that the present invention is defined by the following claims construed in light of the prior art so that modifications or changes may be made to the preferred embodiments of the present invention without departing form the inventive concepts contained herein.

I claim:

1. A step module adapted for use in constructing stairways and the like wherein a plurality of step modules are attached to one another as adjacent pairs of lower and upper step modules whereby a first one of the adjacent pair defines an upper step and a second one of the adjacent pair defines a lower step, said upper and lower steps respectively having upper and lower treads for said stairway, each said step module comprising:

a tread portion and a riser portion connected together to form a nosing, said tread portion having an upper surface, a lower surface and a distal tread edge opposite said nosing, said riser portion having a front surface, a rear surface and a distal riser edge opposite said nosing; and a first shoulder means attachable to said riser portion for forming a shoulder support along the front surface thereof, said shoulder support being substantially parallel to said nosing and located a first distance below said nosing, said first shoulder means forming a tread seat whereby the distal tread edge of a lower step module may be supported by said first shoulder means and attached to said riser portion of an upper step module;

an attachment means attachable to the rear surface of the riser portion and located intermediate of the nosing and the distal riser edge.

2. A step module according to claim 1 including means for adjustably attaching said first shoulder means to said riser portion whereby said first distance can be selectively varied.

3. A step module according to claim 1 wherein said first shoulder means is spaced a second distance above the distal riser edge whereby the riser portion and the tread portion of a lower step module and the riser portion of an upper step module form an inverted channel when attached to one another, and including cover means for enclosing the channel opposite the tread portion.

4. A step module according to claim 3 wherein said step module includes a wing portion connected to said riser portion along the distal riser edge and projecting oppositely of said tread portion, said wing portion of an upper step module underlying the tread portion of a lower step module in spaced relation thereto to define said cover means when said upper and lower step modules are attached together.

5. A step module according claim 3 wherein said cover means is a channel shaped cover plate.

6. A step module according to claim 3 wherein said cover means includes a cover plate mountable between the rear surface of the riser portion of a lower step module and the distal riser edge of an upper step module whereby the riser portion of the lower step module and the riser portion of the upper step module are adjacent riser portions.

7. A step module according to claim 6 including attachment means having a second shoulder means attachable to the rear surface of the riser portion of the lower step module substantially parallel to the nosing thereof a cover plate attached and supported by said shoulder means, for supporting said cover plate located between the adjacent riser portions

8. A step module according to claim 3 including means for enclosing opposite ends of said channel to form an enclosed chamber having an interior bounded by the riser portion and the tread portion of said lower step module, the riser portion of said upper step module, said cover means and said means for enclosing.

9. A step module according to claim 8 wherein the stairway includes lateral supports formed by stingers, wall supports, said means for enclosing being defined by lateral supports.

10. A step module according to claim 9 including a filler material in the interior of said chamber.

11. A step module according to claim 10 wherein said filler material is an acoustical dampening material.

12. A step module according to claim 11 wherein said filler material is selected from: polyurethane, urethane foam, foaming polymers, rubber, foam rubber, cement, epoxy, plastic foaming material, insulating material, styrofoam.

13. A step module according to claim 10 wherein said filler material is a structural strengthening material.

14. A stairway assembly adapted to be mounted between lateral stairway supports such as stingers, wall supports, comprising:

a lower landing portion;

an upper landing portion;

a plurality of step modules attached to one another as adjacent pairs of lower and upper step modules extending from a lowermost step module adjacent said lower landing portion to an uppermost step module adjacent said upper landing portion, each said step module having a tread portion and a riser portion connected together along a nosing such that said tread portion has an upper surface, a lower surface and a distal tread edge opposite and parallel to said nosing and such that said riser portion has a front surface, a rear surface and a distal riser edge opposite of and parallel to said nosing;

said plurality of step modules connected togehter in a lower step-wise manner such that the distal tread edge of one step module is attachable and located at a first distance below said nosing to the front surface of the riser portion of a second upper step module whereby an inverted channel defined by the riser portion and the tread portion of the lower module, and the riser portion and the tread portion of the upper module is formed;

cover means connected at the front surface of the distal edge of the riser portion of a second step module and to the rear surface of the riser portion of the first step module for enclosing said inverted channel opposite the associated tread portion;

said lateral supports, said channel and said cover means on each adjacent pair of step modules forming an enclosed chamber having an interior bounded by the riser portion and the tread portion of said lower step module, the riser portion of said upper step module, said cover means and said lateral supports.

15. A stairway assembly according to claim 14 including means for adjustably attaching the distal tread edge of one step module to the front surface of the riser portion of a second step module whereby said first distant can be varied.

16. A stairway assembly according to claim 14 including a filler material in the interior of said chamber.

17. A stairway assembly according to claim 14 wherein said filler material is an acoustical dampening material.

18. A stairway assembly according to claim 14 wherein said filler material is a structural strengthening material.

19. A stairway assembly according to claim 14 wherein the lower landing portion is attached to the lowermost step module of said plurality of step modules so that the said lower landing extends outwardly from said lowermost step module.

20. A stairway assembly according to claim 14 wherein the upper landing portion is attached to the uppermost step module of said plurality of step modules so that the upper landing extends outwardly from said uppermost step module.

21. A stairway assembly according to claim 14 wherein said landings are mounted to vertical supports, each said landing including a landing surface having a distal landing edge and a proximal landing edge, said distal landing edge adapted to abut the uppermost step module and said proximal landing edge adapted to abut a said vertical support, said landing surface supported by a plurality of headers mounted to said vertical supports, and at least one cover plate mounted below said landing surface between respective ones of said headers and operative to form an enclosed chamber therewith, and enclosed chamber having an interior bounded by said landing surface, the lateral supports, the headers and the cover plates.

22. A stairway assembly according to claim 20 including a filler material in the interior of said chamber.

23. A stairway assembly according to claim 22 wherein said filler material is an acoustical dampening material.

24. A method for forming a stairway between an upper landing and a lower landing comprising the steps of:

providing a plurality of step modules each having a riser portion and a tread portion connected together to form a nosing such that said tread portion has an upper surface, a lower surface and a distal tread edge opposite of and parallel to said nosing and such that said riser portion has a front surface, a rear surface and a distal riser edge opposite of and parallel to said nosing;

attaching said plurality of step modules together in a step-wise manner such that the tread portion of one step module is attached to the front surface of an upper adjacent module along a line of attachment spaced above the distal riser edge of the adjacent step module and below said nosing is substantially parallel relation thereto whereby forming an inverted channel whereby a set of steps is formed;

attaching an attachment means to the rear surface of the riser portion, intermediate of the nosing and the distal riser edge.

attaching an uppermost step module of said set of steps to said upper landing so that the riser portion of said uppermost step module depends downwardly from said upper landing;

attaching a lowermost step module of said set of steps to said lower landing so that the riser portion of said lowermost step module extends upwardly from said lower landing;

enclosing said channel to form a chamber having an interior; and filling said chamber with a filler material.

25. A method according to claim 24 wherein said step of enclosing and channel includes attaching a cover plate between the distal riser edge of an upper step module to the riser portion of an adjacent lower module in spaced relation to the tread portion of the lower step module.

26. A method according to claim 25 wherein said chamber when enclosed has a port formed therein, the step of filling said chamber with a filler material being accomplished by injecting said filler material into said chamber through said port.

27. A method according to claim 26 including the step of sealing said port after the filler material is injected therethrough.

28. A method according to claim 24 wherein the step of attaching said plurality of step modules together is accomplished by welding a respective distal tread edge to a respective riser portion along a line of attachment.

29. A method according to claim 28 including the step of forming a shoulder along each riser portion that will receive and support the respective distal tread edge.

* * * * *